US005655271A

United States Patent [19]

Maxwell-Trumble et al.

[11] Patent Number: 5,655,271

[45] Date of Patent: Aug. 12, 1997

[54] PINLESS CLOTHING ATTACHABLE IMAGE HOLDER BUTTON

[76] Inventors: Susan Maxwell-Trumble; Allen R. Trumble, both of 32 Oak St., Babylon, N.Y. 11702

[21] Appl. No.: 649,853

[22] Filed: May 7, 1996

[51] Int. Cl.[6] ..... A44C 3/00

[52] U.S. Cl. ..... 24/459; 40/1.5; 40/603; 24/113 MP; 24/3.1

[58] Field of Search ..... 24/72.5, 455, 588, 24/92, 104, 114.4, 114.12, 114.9, 113 R, 113 MP, 459; 38/102.2; 40/1.5, 603, 707, 732, 797

[56] References Cited

U.S. PATENT DOCUMENTS

| | | | |
|---|---|---|---|
| D. 356,832 | 3/1995 | Maxwell-Trumble et al. | D20/22 |
| 3,407,523 | 10/1968 | Winston | 40/1.5 |
| 4,184,275 | 1/1980 | Thornell | 40/1.5 |
| 4,597,206 | 7/1986 | Benson | 40/1.5 |
| 4,604,819 | 8/1986 | Grey | 40/1.5 |
| 4,644,639 | 2/1987 | Atteberry et al. | 38/102.2 X |
| 4,723,367 | 2/1988 | Samoilov et al. | 38/102.2 |
| 4,726,130 | 2/1988 | Bussard | 38/102.2 |
| 5,033,170 | 7/1991 | Ewert | 24/459 |
| 5,369,899 | 12/1994 | Reeves | 40/1.5 |
| 5,398,435 | 3/1995 | Kanzelberger | 40/1.5 |
| 5,511,289 | 4/1996 | Melia | 24/459 X |

*Primary Examiner*—Peter M. Cuomo
*Assistant Examiner*—Robert J. Sandy
*Attorney, Agent, or Firm*—Galgano & Burke

[57] ABSTRACT

A clothing accessory includes a molded plastic plate and a molded plastic ring. The periphery of the plate is provided with a first engagement surface and the interior of the ring is provided with a second engagement surface. The relative dimensions of the plate and the ring are chosen such that the fabric of an article of clothing can be engaged between the first and second engagement surfaces. More specifically, when the ring is placed on one side of a fabric and the plate is placed on the other side of a fabric, the plate and ring may be pressed together so that the plate is frictionally engaged inside the ring by the fabric of the clothing. According to a presently preferred embodiment, the engagement surfaces are V-shaped. I.e. one of the surfaces is a concave V-shaped groove and the other is a convex V-shaped edge. Other preferred aspects of the invention include providing a peripheral lip on the plate which extends substantially orthogonal to one side surface of the plate to define an image receiving area. According to the invention, a photograph, hologram or other decorative indicia is attached to the plate by providing the indicia on a material which is attached to the plate with an adhesive. Preferably, the material is a self-adhesive, peel and stick material. A kit according to the invention, includes a plate, a ring, and a plurality of self-adhesive labels, each bearing different decorative indicia.

14 Claims, 2 Drawing Sheets

PINLESS CLOTHING ATTACHABLE IMAGE HOLDER BUTTON

BACKGROUND OF THE INVENTION

1. Field of the Invention

The invention relates to a clothing accessory which is attachable to an article of clothing. More particularly, the invention relates to a clothing accessory which displays pictographic indicia such as a photograph or a hologram and which is attachable to an article of clothing without the use of a pin.

2. State of the Art

Various clothing accessories are known in the art. Many known accessories are attachable to an article of clothing and bear decorative indicia. Such accessories include pins and badges bearing decorative indicia including photographs. For example, "photo buttons" are presently available and generally include a circular or rectilinear badge which is attachable to an article of clothing by means of a pin which pierces the clothing in two places. The button is typically a laminated structure having a metal backplate which bears the pin and a plastic coated front which covers a photograph. Often the "photo buttons" are made to order and bear a photograph of the wearer. The known "photo buttons" have several disadvantages. The metallic components are relatively expensive. The pin used to attach the button to clothing damages the clothing. Assembly of the button is difficult and usually requires a special laminating machine to attach the photograph to the button. In addition, metal backed photo buttons are relatively heavy which places strain on the article of clothing and thereby exacerbates the damage to the clothing caused by the pin.

My earlier design patent DES. 356,832 disclosed a "clothing attachable image holder" having two square-shaped pieces which snap together with the fabric of an article of clothing therebetween. The first square piece has a planar front surface, a centrally grooved back surface, and a pair of raised ridges on two opposite edges. The second square piece has a square-shaped opening for receiving the first square piece, a central cross member which is received by the central groove on the back surface of the first piece, and a pair of ridge receiving recesses on opposite internal edges of the square-shaped opening. In actual use, a square-shaped image is affixed to the planar surface of the first square piece using an adhesive. The image holder avoids many of the disadvantages of the prior art, but is unnecessarily complicated to use because the central groove must be aligned with the central cross member. This is not always simple because the two members are visually separated by the clothing fabric. In addition, the provision of the cross member and the central groove limit the utility of the holder by limiting the orientation of the two pieces. The cross member and the groove also mandate a more complicated mold to manufacture the pieces.

SUMMARY OF THE INVENTION

It is therefore an object of the invention to provide a clothing accessory which is attachable to an article of clothing without the use of a pin.

It is another object of the invention to provide a clothing accessory capable of bearing pictographic or holographic indicia in which attachment of the indicia to the accessory is simple and inexpensive.

It is still another object of the invention to provide a clothing accessory which is light weight and thus will not unduly strain an article of clothing to which it is attached.

It is also an object of the invention to provide a clothing accessory which is inexpensive and easy to manufacture.

Still another object of the invention is to provide a clothing accessory which is easy to attach to an article of clothing in several different orientations.

In accord with these objects which will be discussed in detail below, the clothing accessory of the present invention includes a molded plastic plate and a molded plastic ring. The periphery of the plate is provided with a first engagement surface and the interior of the ring is provided with a second engagement surface. The relative dimensions of the plate and the ring are chosen such that the fabric of an article of clothing can be engaged between the first and second engagement surfaces. More specifically, when the ring is placed on one side of a fabric and the plate is placed on the other side of a fabric, the plate and ring may be pressed together so that the plate is frictionally engaged inside the ring by the fabric of the clothing. According to a presently preferred embodiment, the engagement surfaces are V-shaped. I.e. one of the surfaces is a concave V-shaped groove and the other is a convex V-shaped edge. Other preferred aspects of the invention include providing a peripheral lip on the plate which extends substantially orthogonal to one side surface of the plate to define an image receiving area. According to the invention, a photograph, hologram or other decorative indicia s attached to the plate by providing the indicia on a material which is attached to the plate with an adhesive. Preferably, the material is a self-adhesive, peel and stick material. A kit according to the invention, includes a plate, a ring, and a plurality of self-adhesive labels, each bearing different decorative indicia. While the presently preferred embodiment of the invention provides a circular plate and circular ring, other embodiments provide other geometric shapes may be suitable.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
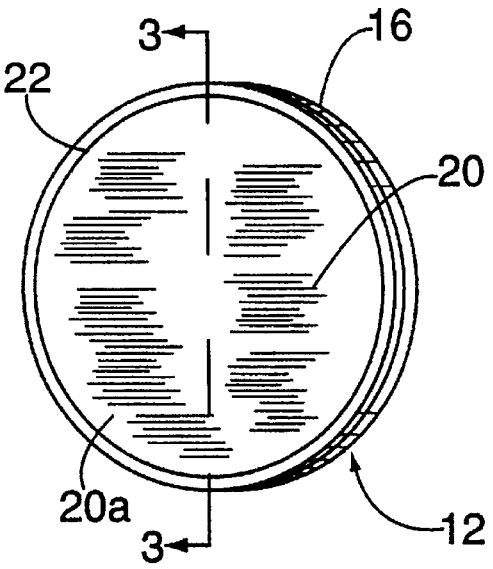
FIG. 1 is a perspective view of a circular plate portion of a first embodiment of the invention.
Figure 2:
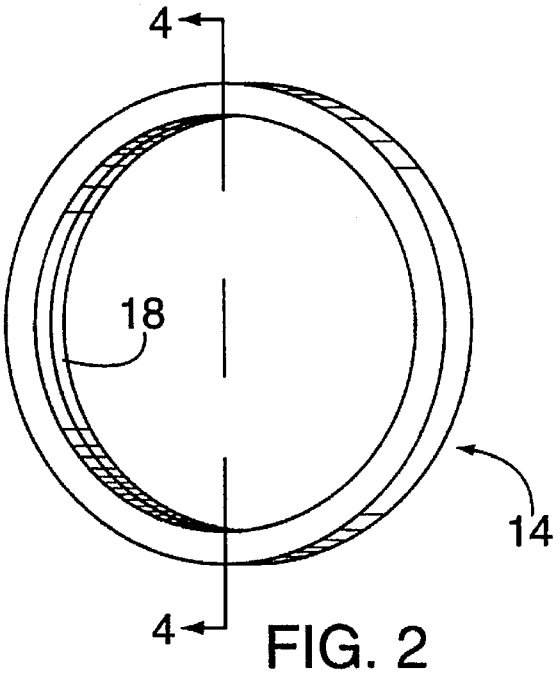
FIG. 2 is a perspective view of a circular ring portion of a first embodiment of the invention.
Figure 3:
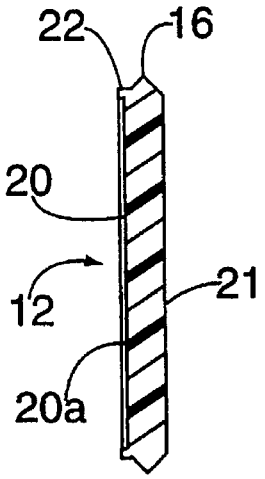
FIG. 3 is a cross section taken along line 3—3 in FIG. 1.
Figure 4:
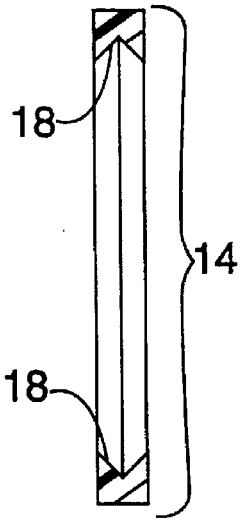
FIG. 4 is a cross section taken along line 4—4 in FIG. 2.

Referring now to FIGS. 1 through 5, a first embodiment of the clothing accessory 10 according to the invention includes a circular plate or panel 12 and a circular ring or frame 14. The plate 12 is provided with a convex-like V-shaped peripheral ridge 16 and the ring 14 is provided with a concave-like V-shaped interior groove 18. Further, the plate 12 is preferably provided with a substantially planar front surface 20 which is preferably surrounded by a peripheral upstanding lip 22 which defines an image receiving area 20*a*. As seen best in FIG. 5, the clothing accessory 10 is attached to the fabric 7 of an article of clothing by locating the ring 14 against the back side 7*b* of the fabric 7 and placing the plate 12 against the front side 7*a* of the fabric 7 so that the plate 12 and the ring 14 are aligned. Pressing the plate 12 and the ring 14 together frictionally engages the fabric 7 between the ridge 16 on the plate 12 and the groove 18 on the ring 14. In this mounted position, the front surface of the plate 12 lies substantially flush with the front side 7*a* of the fabric 7 so as to give the appearance that the plate 12 is integral or part of the shirt and doesn't protrude outwardly from the fabric in contrast to a typical button or pin. The accessory 10 will remain securely attached to the fabric 7, but may be easily removed by pushing the plate 12 (and the fabric 7) out of the ring 14 from the back side 7*b* of the fabric 7.

From the foregoing, those skilled in the art will appreciate that the relative dimensions of the plate and the ring should be chosen so that the fabric of an article of clothing will be captured securely between the plate and the ring. It will therefore be appreciated that different relative dimensions may be chosen to accommodate different types of fabrics. For example, in the case of a cotton shirt fabric, the external diameter of the plate should be approximately one sixteenth of an inch smaller than the internal diameter of the ring. A typical embodiment of the invention will have a plate with a diameter of approximately one to three inches.

Figure 5:
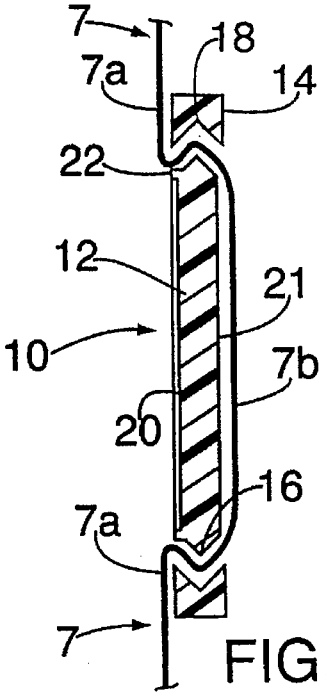
FIG. 5 is a cross sectional-view of the plate and ring of FIGS. 1 and 2 attached to an article of clothing.
Figure 6:
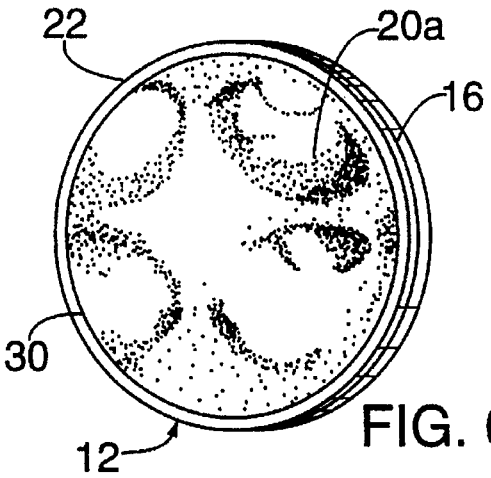
FIG. 6 is a view similar to FIG. 1 with an adhesive indicia bearing member attached to the plate.
Figure 9:
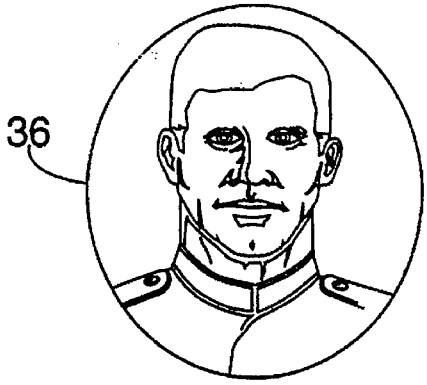
FIG. 9 is a plan view of self-adhesive label bearing a photograph for attachment to the plate of FIG. 1.
Figure 7:
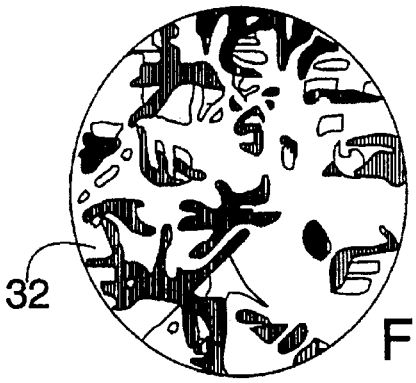
FIGS. 7 and 8 are plan views of self-adhesive indicia bearing labels for attachment to the plate of FIG. 1.
Figure 8:
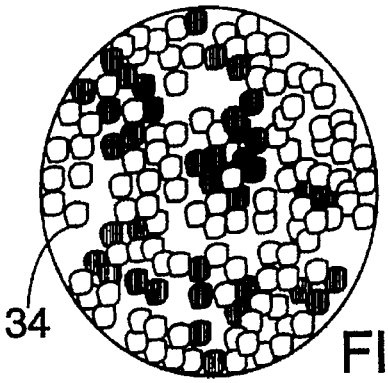

As mentioned above, the image receiving area 20*a* of the plate 12 is designed to accept an adhesive label or other decorative indicia bearing article by means of an adhesive. FIG. 6 shows the plate 14 with a self-adhesive label 30 attached to the image receiving area 20*a*. When the plate 12 carrying the label 30 is mated with the ring 14 as shown in FIG. 5, the decorative indicia on the label 30 becomes effectively coupled to the fabric 7 of the clothing. The label 30 shown in FIG. 6 is representative of a holographic image which yields a different appearance depending on the angle of view. According to the invention, the clothing accessory 10 may be provided in a kit form including several self-adhesive labels such as the labels 32 and 34 shown in FIGS. 7 and 8, as well as the label 30 described above. The user of the accessory 10 may then select from a number of different decorative labels for use with the accessory. Furthermore, as shown in FIG. 9, a label 36 may be provided with a photographic image. Such labels may be custom ordered, or may be made to order in a kiosk while the user waits.

Figure 10:
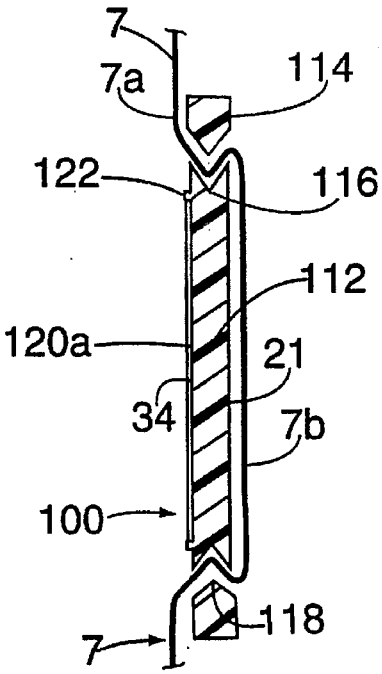
FIG. 10 is a view similar to FIG. 5 of an alternate embodiment of the invention.

As explained above, the plate portion of the accessory is provided with a peripheral engaging means and the ring portion of the accessory is provided with a mating interior engaging means. As described thus far, the plate 12 is provided with convex-like engaging means 16 and the ring 14 is provided with concave-like engaging means 18. FIG. 10 shows an alternate arrangement of a clothing accessory 100. In FIG. 10, the clothing accessory 100 includes a plate 112 provided with V-shaped peripheral groove 116 and a ring 114 provided with an interior V-shaped ridge 118. The clothing accessory 100 functions in substantially the same manner as the accessory 10 described above. FIG. 10 also illustrates a sectional view of how the label 34 of FIG. 8 fits inside the image receiving area 120*a* defined by the peripheral upstanding lip 122. It should also be realized that the rear surface 21 of plate 12 could also be used to receive an image by means of stamping, imprinting or adhesive, as well.

While the presently preferred embodiment of the invention has been described as a circular plate and a circular ring, it will be appreciated that other shapes could be used.

The clothing accessory according to the invention is easily and inexpensively manufactured by injection molding techniques utilizing inexpensive thermoplastic material.

There have been described and illustrated herein several embodiments of a clothing accessory which is attachable to an article of clothing without the use of a pin and which is capable of carrying a label bearing decorative indicia or a photograph. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as so claimed.

What is claimed is:

1. A pinless clothing attachable image holder button attachable to the fabric of an article of clothing, said pinless button comprising:

a) a plate member having a substantially planar front surface and an outermost peripheral surface, said plate member being positionable on a front side of the fabric of an article of clothing;

b) a ring member having an innermost peripheral surface dimensioned to provide a clearance between said outermost peripheral surface and said innermost peripheral surface, said ring member being positionable on a rear side of the fabric of the article of clothing, wherein said plate member and said ring member are dimensioned relative to each other such that when said plate member and said ring member are aligned on opposite sides of the fabric of the article of clothing and pressed together, the fabric of the article of clothing is securely captured between said outermost and innermost peripheral surfaces.

2. A pinless button according to claim 1, wherein:

said plate member is a circular disk and said ring member is a circular ring.

3. A pinless button according to claim 2, wherein:

said circular disk has an outer diameter and said circular ring has an inner diameter, and said outer diameter is approximately one sixteenth of an inch smaller than said inner diameter.

4. A pinless button according to claim 1, wherein:

said peripheral surface has a generally V-shaped profile.

5. A pinless button according to claim 4, wherein:

said inner peripheral surface has a generally V-shaped profile.

6. A pinless button according to claim 5, wherein:

said peripheral surface is convex-like and said inner peripheral surface is concave-like.

7. A pinless button according to claim 5, wherein:

said peripheral surface is concave-like and said inner peripheral surface is convex.

8. A pinless button according to claim 1, wherein said button is attachable to the fabric of the article of clothing with said front surface of said plate member being substantially flush with the front side of the fabric of the article of clothing.

9. A pinless button according to claim 1, further comprising:

c) at least one self-adhesive member bearing decorative indicia, said at least one self-adhesive member being dimensioned to substantially cover said substantially planar surface.

10. A pinless button according to claim 9, wherein:

said at least one self-adhesive member includes a plurality of self-adhesive members, each bearing different decorative indicia.

11. A pinless button according to claim 9, wherein:

said decorative indicia is a photograph.

12. A pinless button according to claim 9, wherein:

said decorative indicia is a hologram.

13. A pinless button according to claim 1, wherein:

said plate member and said ring member are each made of molded thermoplastic.

14. A clothing accessory according to claim 1, wherein:

said substantially planar surface bears decorative indicia.

* * * * *